US006877704B2

(12) United States Patent
Novak et al.

(10) Patent No.: US 6,877,704 B2
(45) Date of Patent: Apr. 12, 2005

(54) DECORATIVE GIFT BAG BALLOON HOLDER

(76) Inventors: Craig Novak, 104 Willow Glen Dr., Kennett Square, PA (US) 19348; Judith Wexler, 18 Bronwood Dr., Voorhees, NJ (US) 08043

( * ) Notice: Subject to any disclaimer, the term of this patent is extended or adjusted under 35 U.S.C. 154(b) by 147 days.

(21) Appl. No.: 09/909,423

(22) Filed: Jul. 19, 2001

(65) Prior Publication Data

US 2003/0015640 A1 Jan. 23, 2003

(51) Int. Cl.[7] ..... A47B 91/00; A47G 29/00; B65D 19/00

(52) U.S. Cl. ..... 248/346.01; 248/910; 446/220; 383/109

(58) Field of Search ..... 248/346.01, 910, 248/188.1, 176.1; 446/220, 225; 383/109; 229/87.19

(56) References Cited

U.S. PATENT DOCUMENTS 1,536,816 A * 5/1925 Sale ..... 446/27
4,784,628 A * 11/1988 McArdle ..... 446/225
4,930,903 A * 6/1990 Mahoney ..... 383/6
5,016,848 A * 5/1991 Metz ..... 248/176.1
5,044,773 A * 9/1991 Harms ..... 383/22
5,441,348 A * 8/1995 Valentino ..... 383/127
5,573,437 A * 11/1996 Van Dyke ..... 446/75
5,755,419 A * 5/1998 Gearhart et al. ..... 248/346.01
6,045,263 A * 4/2000 Keller ..... 383/33
6,146,018 A * 11/2000 Keller et al. ..... 383/78
6,345,912 B1 * 2/2002 Ho ..... 383/20
6,523,798 B1 * 2/2003 Novak ..... 248/346.01

OTHER PUBLICATIONS http://www.thefunplace.com/crafts/bagswrap.html, Mar. 25, 1999.*
http://www.balloonhg.com/faq/deco¯delivery.html.*
http://www.balloonplace.com.*
http://www.thepartyballoon.com/products.html.*

* cited by examiner

*Primary Examiner*—Anita King
*Assistant Examiner*—Amy J. Sterling
(74) *Attorney, Agent, or Firm*—Gerard F. Dunne

(57) ABSTRACT

A balloon holder simulating a small gift bag comprises a decorative bag, a core held within the decorative bag and having sufficient weight to hold at least one buoyant balloon in place, and decorative material secured to the core in a position to conceal the core from casual view. The decorative material preferably is formed from a length of decorative sheet material having its upper portion cut into a series of strips adapted to extend outwardly from the decorative bag. In one embodiment useful for a larger size decorative gift bag, an inner liner is fitted within the decorative bag with the core being held to the interior of the lower portion of the inner liner and the decorative material being held to the interior of the upper periphery of the inner liner.

11 Claims, 4 Drawing Sheets

DECORATIVE GIFT BAG BALLOON HOLDER

FIELD OF THE INVENTION

The present invention relates to a decorative balloon holder for securing one or more buoyant balloons in position on a tabletop or the like.

BACKGROUND OF THE INVENTION

Various devices for holding a buoyant party balloon in a desired position on a tabletop have been proposed, but such products are often not very attractive for use at a festive occasion such as a birthday party, or are relatively expensive to manufacture. The products disclosed in U.S. Pat. Nos. 5,011,447; 5,016,848; 5024011; 5,035,391; 5,074,510; 5,662,510 or 5,755,419, for example, are manufactured by molding synthetic plastics or comparable techniques and the resulting products can not usually be made festive in appearance without additional expense or bother for the consumer.

Balloon holders formed of a core of weighted mass of compacted sand, or cement and sand mixtures, have been proposed that are wrapped in a festive paper, and such balloon holders have met a need for inexpensive but festively decorated party props to secure buoyant balloons. In an earlier application by one of the inventors, Ser. No. 565,709 filed May 5, 2000, an attachment for securing the string of the balloon is held directly to the core and a decorative layer of material is held around the core to provide a festive balloon holder that can be manufactured inexpensively and yet can hold a balloon securely in place.

Other balloon holders have been used that are formed of a small gift bag that may have a weight such as small lead fishing weights or sand placed in the bottom of the gift bag with decorative tissue paper placed loosely inside to cover the weight. Such balloon holders simulating a gift bag are festive and very desirable for many party occasions where buoyant balloons need to be held in place on a tabletop or the like.

However, such balloon holders simulating a gift bag are typically made individually and are not manufactured readily by automatic techniques nor can they be shipped, stored or displayed in a retail environment satisfactorily. It is, therefore, an object of the present invention to provide a decorative balloon holder that may simulate a gift bag and yet can be manufactured, stored, shipped and displayed at retail in a manner preserving the decorative appeal of the balloon holder.

SUMMARY OF THE INVENTION

According to the present invention, a balloon holder simulating a gift bag is provided by a decorative bag. A core having sufficient weight to hold at least one buoyant balloon in place is positioned within the decorative bag, and decorative material is secured to the core in a position to conceal the core from casual view. The decorative material is preferably formed from a length of decorative sheet material having its upper portion cut into a series of strips adapted to extend outwardly from the decorative bag and its lower portion held around the periphery of the core. The decorative bag may have handles extending from an upper portion thereof to serve as an attachment for a string of one or more balloons, and the upper portions of the handles may preferably be fixed together.

In one embodiment of the present invention, the core is held to the interior of the decorative bag. In another embodiment of the present invention, an inner liner is fitted within the decorative bag, and the core is held to the interior of the lower portion of the inner liner and the decorative material is held to the interior of the upper periphery of the inner liner.

These and other objects, and advantages and features of the present invention will become apparent from the description given below which is made in conjunction with the following drawing figures.

Figure 1:
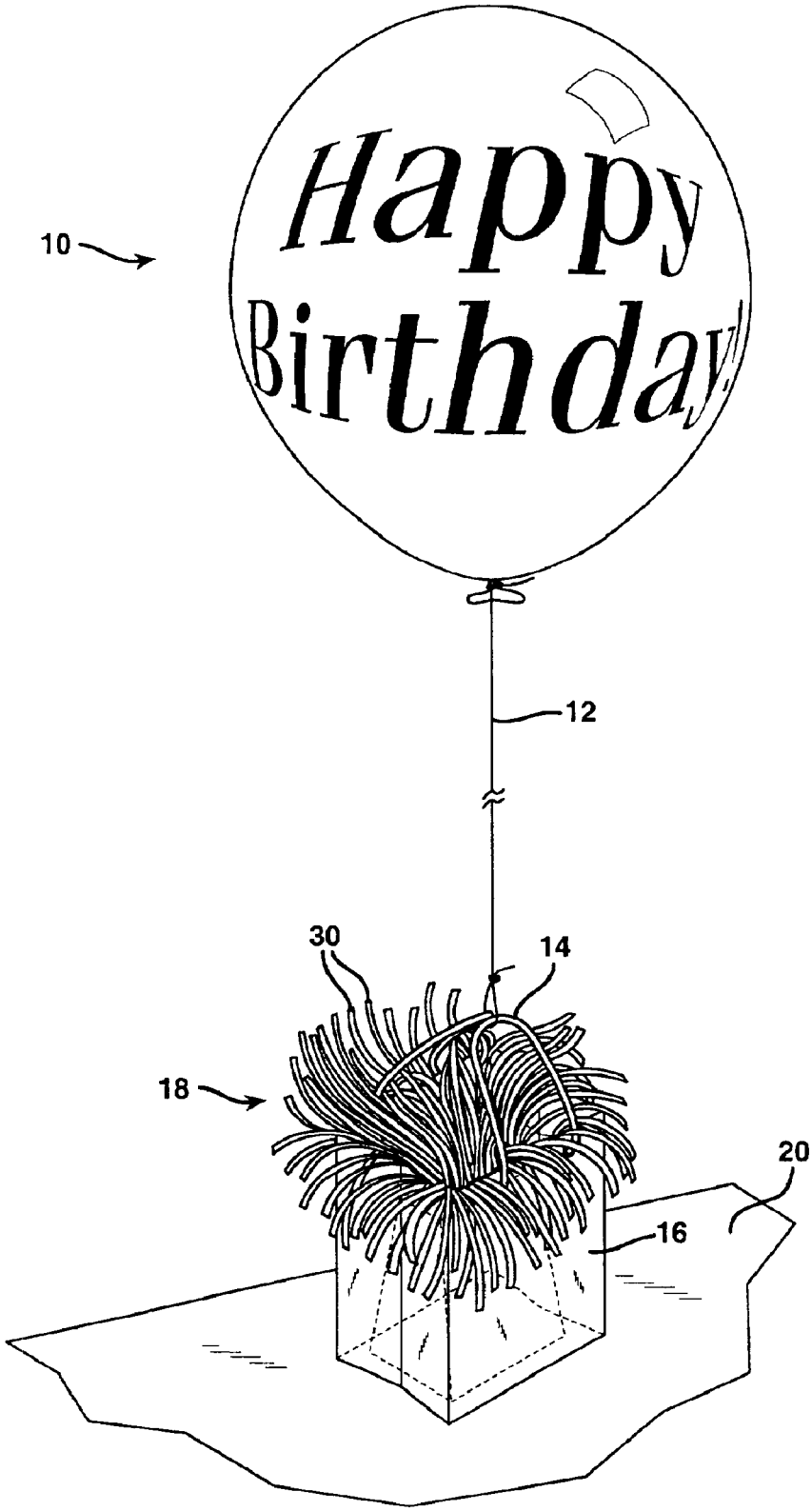
FIG. 1 is a perspective view of a balloon holder according to one embodiment of the present invention.

As illustrated in FIG. 1, a party balloon 10 has a string 12 tied to handles 14 of a decorative gift bag 16 forming part of the balloon holder 18 of the first illustrated embodiment of the present invention. The balloon holder 18 is resting on a tabletop 20 and has sufficient weight to counteract the buoyancy of one or more balloons 10.

Figure 2:
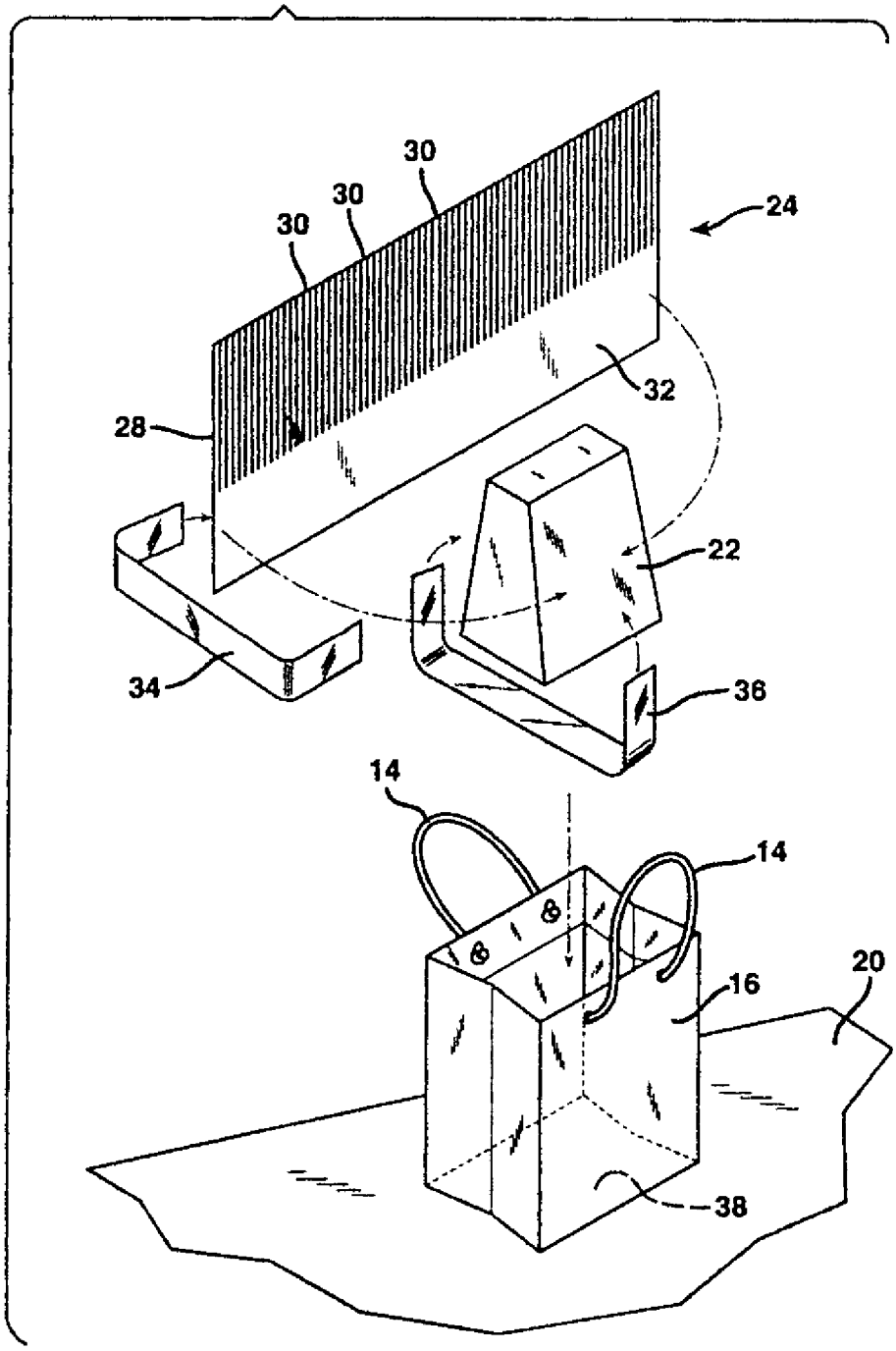
FIG. 2 is an exploded view thereof.

FIG. 2 illustrates the construction of the first embodiment of a balloon holder of the present invention, and a core 22 formed of an inexpensive but weighty material such as compressed sand held by an adhesive or a sand, cement and water mixture, is formed into a shape corresponding to the interior of the gift bag. Preferably, the core 22 is trapezoidal in section to taper towards the top of the bag, and a mixture of approximately 72% sand, 24% cement and 4% water has been found satisfactory to hold one or more typical Mylar balloons inflated with helium.

Decorative material extends outwardly from the open top of the gift bag 16, and as illustrated in FIG. 2, the decorative material is formed from a length 24 of decorative sheet material having its upper portion 28 cut into a series of strips 30 adapted to extend outwardly from the open top of the decorative bag 16, as illustrated in FIG. 1. The lower portion 32 of the decorative material is held around the periphery of the core 22 by orthogonal strips of tape 34 and 36. In this way, the decorative material is held to the core 22 around its generally rectangular periphery to conceal the inner core 22 from casual view by forming a decorative effect about the rectangular opening in the top of the gift bag 16 when the strips 30 are arranged to extend outwardly from the open gift bag 16.

In preferred form, the core 22 may be adhered to the bottom 38 of the gift bag 38 by an adhesive, tape or the like to secure the assembly together, and the upper portions of the handles 14 may be secured together by adhesive, tape, fine line or the like. By holding the decorative material to the core 22, the decorative material will stay in place during shipment, storage or handling. A decorative balloon holder simulating a gift bag is thus suitable for manufacture reliably by automated techniques and can be shipped securely and handled at retail while maintaining its attractiveness to the consumer.

Figure 3:
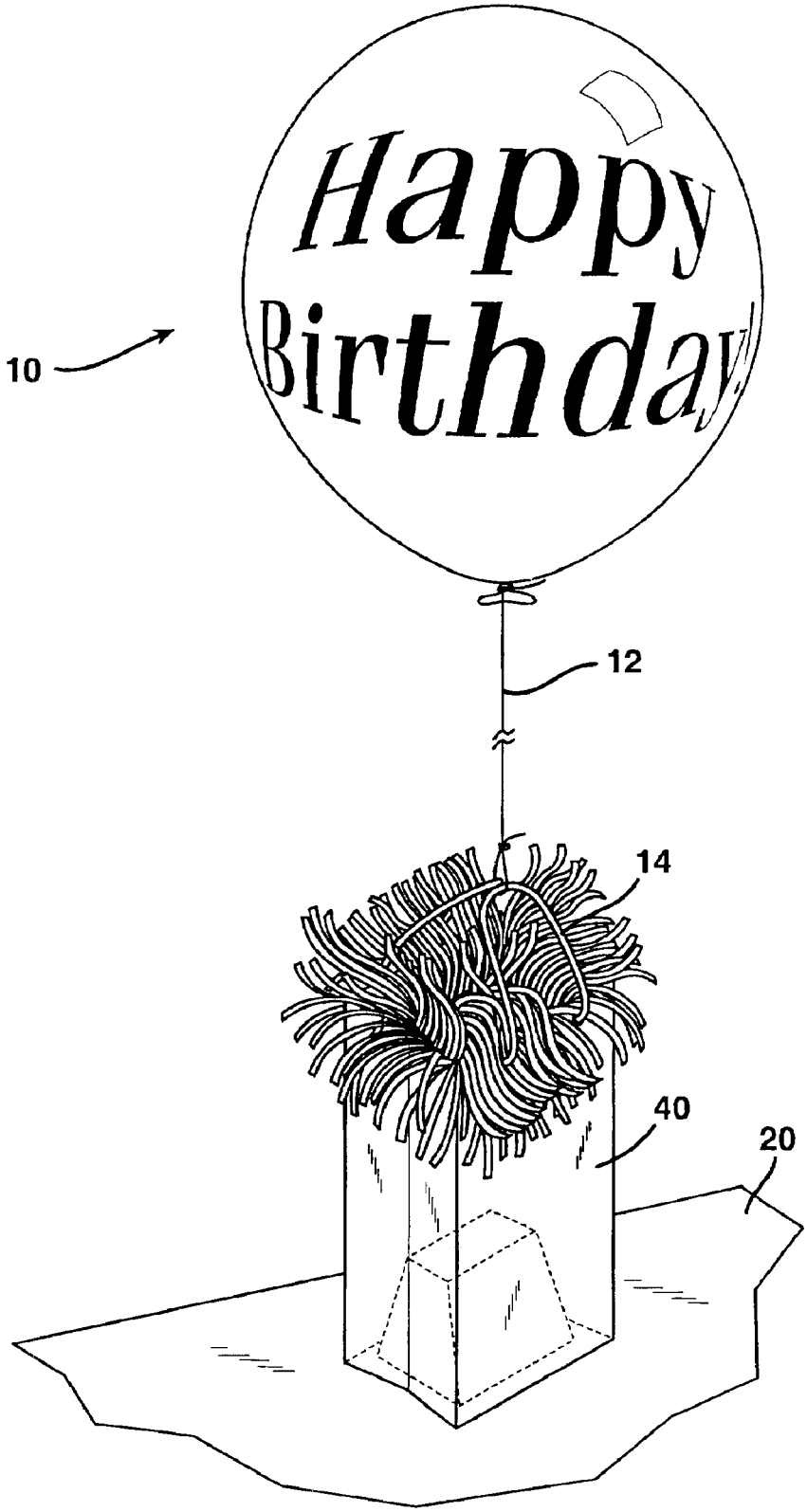
FIG. 3 is a perspective view of a balloon holder according to another embodiment of the present invention suitable for a larger gift bag.
Figure 4:
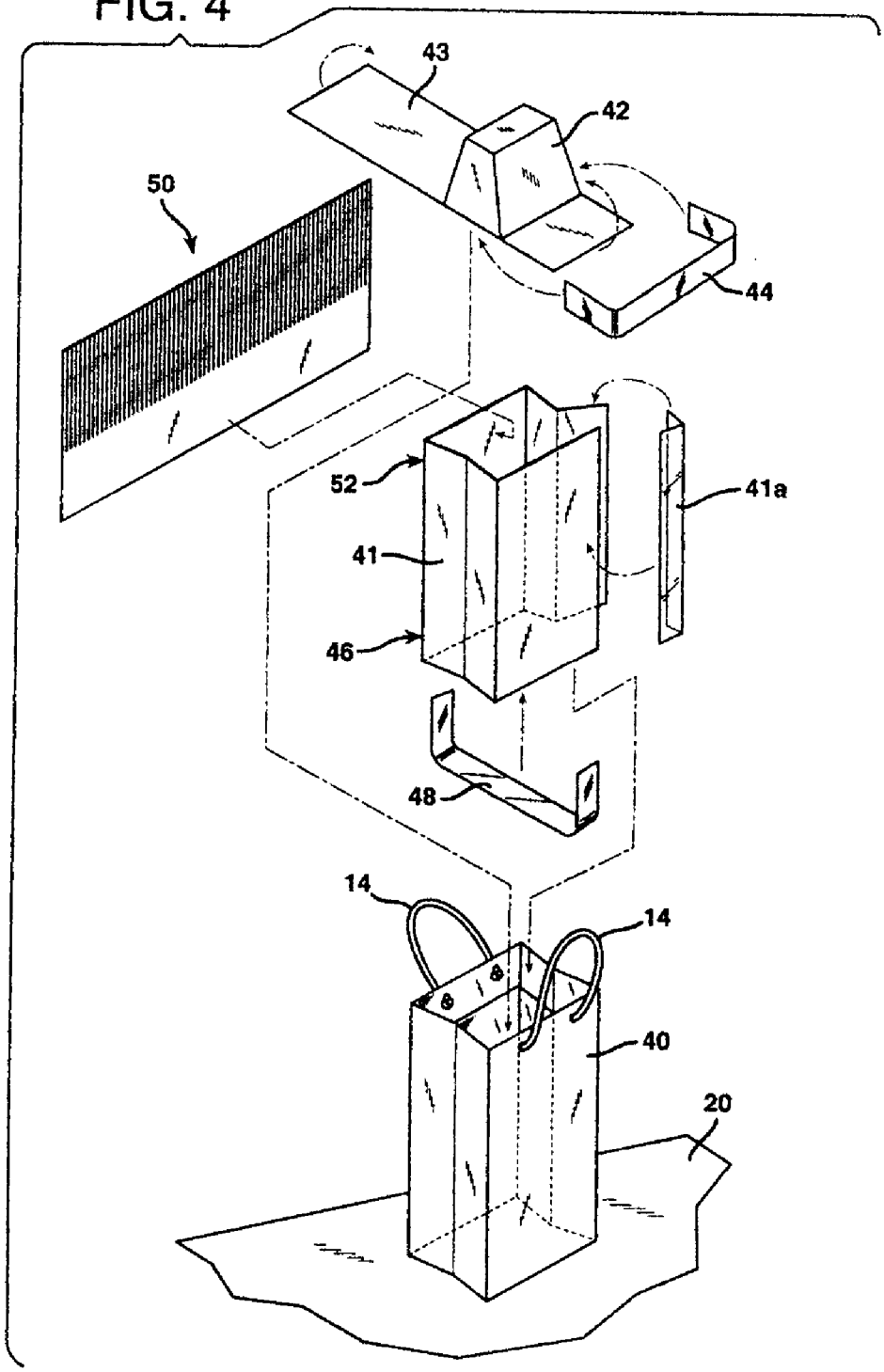
FIG. 4 is an exploded view of the embodiment of FIG. 3.

FIG. 3 illustrates an embodiment having a larger gift bag 40. As shown in FIG. 4, an inner liner 41 conforming generally to the shape of the interior of the gift bag 40 is fitted within the gift bag 40. The inner liner may be formed of cardstock and is folded into shape and secured by tape 41*a*.

The core 42 is preferably wrapped in protective paper 43 secured by tape 44, and the core 42 is held to the interior of the lower portion 46 of the inner liner 41 by one or more strips of tape 48 engaging the bottom of the wrapped core 42 and the sides of the inner liner 41. The decorative material 50 formed in a manner similar to the decorative material 30 of the first embodiment is held to the interior of the upper periphery 52 of the inner liner 41.

By use of the inner liner 41, a balloon weight formed of a larger size gift bag will have support to maintain its decorative shape and assemblage during handling and shipment. As in the first embodiment, the upper portions of the handles 14 may be secured together by adhesive, tape, fine line or the like to complete the assemblage.

These and other objects, advantages and features of the present invention will be understood from the detailed description made above; and it is understood that the present invention is not limited by any details set forth above, but by the appended claims.

What is claimed is:

1. A balloon holder, comprising a decorative bag, a core having sufficient weight to hold at least one buoyant balloon in place and positioned within said decorative bag, and decorative material held to said core in a position to conceal said core from casual view, said decorative bag having handles extending from an upper portion thereof to serve as an attachment for a string of one or more balloons, the upper portions of said handles being secured together.

2. A balloon holder as set forth in claim 1, said core being secured to the interior of said decorative bag.

3. A balloon holder as set forth in claim 2, said decorative material being formed from a length of decorative sheet material having its upper portion cut into a series of strips adapted to extend outwardly from said decorative bag and its lower portion secured around the periphery of said core.

4. A holder for a balloon as set forth in claim 1, including an inner liner fitted within said decorative bag, said core being held to the interior of the lower portion of said inner liner and said decorative material being held to the upper periphery of said inner liner.

5. A balloon holder as set forth in claim 4, said decorative material being formed from a length of decorative sheet material having its upper portion cut into a series of strips adapted to extend outwardly from said decorative bag and its lower portion held around the upper periphery of said inner.

6. A balloon holder as set forth in claim 1, said decorative material being formed from a length of decorative sheet material having its upper portion cut into a series of strips adapted to extend outwardly from said decorative bag and its lower portion held within said decorative bag.

7. A balloon holder, comprising a decorative bag, means including a core formed of a weighty mass of dense material provided with sufficient weight for holding a plurality of buoyant party balloons in place, said core being positioned within said decorative bag, and means including decorative material secured within said bag in a position to conceal said core from casual view and extending outwardly from said bag as the balloon holder is displayed for retail sale for providing decorative appeal for the balloon holder at retail display, said decorative bag having handles extending from an upper portion thereof to serve as an attachment for a string of one or more balloons, the upper portions of said handles being secured together.

8. A balloon holder as set forth in claim 7, said core being secured to the interior of said decorative bag.

9. A balloon holder, comprising a decorative bag, a core formed of a weighty material adapted to hold one or more buoyant balloons in place and secured to the interior of said decorative bag, said decorative bag concealing said core from casual view, said core having sidewalls generally trapezoidal in shape to taper towards the upper portion of said decorative bag, said decorative bag having handles extending from an upper portion thereof to serve as an attachment for a string of one or more balloons, the upper portions of said handles being secured together.

10. A balloon holder as set forth in claim 7, said core being formed of compressed sand held by an adhesive material.

11. A balloon holder as set forth in claim 7, said core being formed of compressed sand, cement and water mixture.

* * * * *